US008395472B2

(12) United States Patent
Roozeboom et al.

(10) Patent No.: US 8,395,472 B2
(45) Date of Patent: Mar. 12, 2013

(54) PLANAR, MONOLITHICALLY INTEGRATED COIL

(75) Inventors: Freddy Roozeboom, Waalre (NL); Derk Reefman, Best (NL); Johan Hendrik Klootwijk, Eindhoven (NL); Lukas Frederik Tiemeijer, Eindhoven (NL); Jaap Ruigrok, Asten (NL)

(73) Assignee: NXP B.V., Eindhoven (NL)

( * ) Notice: Subject to any disclaimer, the term of this patent is extended or adjusted under 35 U.S.C. 154(b) by 67 days.

(21) Appl. No.: 13/002,152

(22) PCT Filed: Jun. 30, 2009

(86) PCT No.: PCT/IB2009/052836

§ 371 (c)(1),
(2), (4) Date: Dec. 30, 2010

(87) PCT Pub. No.: WO2010/001339

PCT Pub. Date: Jan. 7, 2010

(65) Prior Publication Data

US 2011/0128111 A1 Jun. 2, 2011

(30) Foreign Application Priority Data

Jul. 2, 2008 (EP) ..... 08159531

(51) Int. Cl.
*H01F 5/00* (2006.01)
*H01F 27/28* (2006.01)
*H01F 27/24* (2006.01)

(52) U.S. Cl. ..... 336/200; 336/223; 336/233

(58) Field of Classification Search ..... 336/200, 336/223, 232
See application file for complete search history.

(56) References Cited

U.S. PATENT DOCUMENTS

| | | | | |
|---|---|---|---|---|
| 4,828,931 | A * | 5/1989 | Ogawa et al. | 505/233 |
| 6,452,249 | B1 * | 9/2002 | Maeda et al. | 257/531 |
| 6,593,838 | B2 * | 7/2003 | Yue | 336/84 C |
| 6,696,910 | B2 * | 2/2004 | Nuytkens et al. | 336/200 |
| 6,882,547 | B2 * | 4/2005 | Arz | 361/816 |
| 7,196,600 | B2 * | 3/2007 | Westphal | 335/216 |

(Continued)

FOREIGN PATENT DOCUMENTS

| | | |
|---|---|---|
| DE | 101 44 380 A1 | 3/2003 |
| EP | 1 315 181 A1 | 5/2003 |

(Continued)

OTHER PUBLICATIONS

International Search Report and Written Opinion for Int'l. Patent Appln. No. PCT/IB2009/052836 (Dec. 16, 2009).

*Primary Examiner* — Mohamad Musleh
*Assistant Examiner* — Joselito Baisa
(74) *Attorney, Agent, or Firm* — Kramer & Amado P.C.

(57) ABSTRACT

The present invention provides a means to integrate planar coils on silicon, while providing a high inductance. This high inductance is achieved through a special back- and front sided shielding of a material. In many applications, high-value inductors are a necessity. In particular, this holds for applications in power management. In these applications, the inductors are at least 5 of the order of 1 μH, and must have an equivalent series resistance of less than 0.1Ω. For this reason, those inductors are always bulky components, of a typical size of 2×2×1 mm 3, which make a fully integrated solution impossible. On the other hand, integrated inductors, which can monolithically be integrated, do exist. However, these inductors suffer either from low inductance values, or 10 very-high DC resistance values.

18 Claims, 3 Drawing Sheets

U.S. PATENT DOCUMENTS

| | | | | |
|---|---|---|---|---|
| 7,518,480 | B1 * | 4/2009 | Dening et al. | 336/200 |
| 7,531,407 | B2 * | 5/2009 | Clevenger et al. | 438/238 |
| 7,750,408 | B2 * | 7/2010 | He et al. | 257/355 |
| 7,750,413 | B2 * | 7/2010 | Hayashi et al. | 257/374 |
| 2003/0016518 | A1 * | 1/2003 | Arz | 361/818 |
| 2003/0034867 | A1 | 2/2003 | Berthold et al. | |
| 2003/0178695 | A1 | 9/2003 | Kamijima | |
| 2003/0184426 | A1 | 10/2003 | Song | |
| 2003/0191940 | A1 | 10/2003 | Sinha et al. | |
| 2005/0156700 | A1 | 7/2005 | Chang | |
| 2005/0275061 | A1 * | 12/2005 | Ohguro | 257/531 |
| 2006/0080531 | A1 | 4/2006 | Sinha et al. | |
| 2006/0157798 | A1 | 7/2006 | Hayashi et al. | |
| 2009/0159657 | A1 * | 6/2009 | Chen et al. | 235/375 |

FOREIGN PATENT DOCUMENTS

| | | | |
|---|---|---|---|
| JP | 8-017656 | A | 1/1996 |
| WO | 2005/036567 | A2 | 4/2005 |

* cited by examiner

PLANAR, MONOLITHICALLY INTEGRATED COIL

FIELD OF THE INVENTION

The present invention provides a means to integrate planar coils on silicon, while providing a high inductance. This high inductance is achieved through a special back- and front sided shielding of a material.

BACKGROUND OF THE INVENTION

In many applications, high-value inductors are a necessity. In particular, this holds for applications in power management. In these applications, the inductors are at least of the order of 1 pH, and must have an equivalent series resistance of less than 0.1Ω. For this reason, those inductors are always bulky components, of a typical size of 2×2×1 $mm^3$, which make a fully integrated solution impossible.

On the other hand, integrated inductors, which can monolithically be integrated, do exist. However, these inductors suffer either from low inductance values, or very high DC resistance values.

US2006157798 discloses a way to mount both an RF circuit including an inductor formed therein and a digital circuit on a single chip. MOSFETs are formed on a semiconductor substrate in regions isolated by an element isolation film. A plurality of low-permittivity insulator rods including a low-permittivity insulator embedded therein and penetrating a first interlevel dielectric film to reach the internal of the silicon substrate is disposed in the RF circuit area. An inductor is formed on the interlevel dielectric film in the RF circuit area by using multi-layered interconnects. A high-permeability isolation region in which a composite material including a mixture of high-permeability material and a low-permittivity material is formed in the region of the core of the inductor and periphery thereof.

JP08017656 discloses a magnetic shielding method and magnetic shielding film forming method of a semiconductor device. The purpose is to minimize the external magnetic effect from inductor conductors formed on a semiconductor substrate. Two inductor conductors are formed on the adjacent positions on the surface of a semiconductor substrate. The inductor conductors are respectively covered with magnetic bodies. In such a constitution, the magnetic fluxes generated by respective inductor conductors are distributed using the magnetic bodies respectively covering said conductors as the magnetic paths so that the magnetic fluxes of the magnetic bodies will be hardly dissipated externally thereby enabling the magnetic effect of respective inductor conductors on any external elements as well as the magnetic coupling with mutual inductor conductors to be avoided.

US2006080531 discloses an implementation of a technology, described herein, for facilitating the protection of computer-executable instructions, such as software. At least one implementation, described herein, may generate integrity signatures of one or more program modules which are sets of computer-executable instructions-based upon a trace of activity during execution of such modules and/or near-replicas of such modules. With at least one implementation, described herein, the execution context of an execution instance of a program module is considered when generating the integrity signatures. With at least one implementation, described herein, a determination may be made about whether a module is unaltered by comparing integrity signatures. This abstract itself is not intended to limit the scope of this patent.

US2003034867 discloses a coil and coil system which is provided for integration in a microelecronic circuit. The coil is placed inside an oxide layer of a chip, and the oxide layer is placed on the surface of a substrate. The coil comprises one or more windings, whereby the winding(s) is/are formed by at least segments of two conductor tracks, which are each provided in spatially separated metallization levels, and by via-contacts which connect these conductor track(s) and/or conductor track segments. In order to be able to produce high-quality coils, a coil is produced with the largest possible coil cross-section, whereby a standard metalization, especially a standard metalization using copper, can, however, be used for producing the oil. To this end, the via contacts are formed from a stack of two ore more via elements arranged one above the other. Parts of the metallization levels can be located between the via elements.

US2003184426 discloses an inductor element having a high quality factor, wherein the inductor element includes an inductor helically formed on a semiconductor substrate and a magnetic material film on a surface of the inductor for inducing magnetic flux generated by the inductor. The magnetic material film preferably includes a first magnetic material film disposed on a lower surface of the inductor, between the substrate and the inductor, and a second magnetic material film disposed on an upper surface of the inductor. The magnetic material film may be patterned according to a direction along which the magnetic flux flows, for example, radial. Since the magnetic material film induces the magnetic flux proceeding toward the upper part and lower part of the inductor, the effect of the magnetic flux generated in the inductor on external circuits may be reduced and the efficiency of the inductor may be enhanced.

Thus there is a need for improved planar coils, not suffering from one or more of the above mentioned disadvantages and drawbacks.

The present invention seeks to provide such an improved coil, not suffering from the one or more drawbacks and disadvantages, which coil further has a high inductance.

SUMMARY OF THE INVENTION

The present invention relates to a planar, monolithically integrated coil, wherein the coil is magnetically confined.

DETAILED DESCRIPTION OF THE INVENTION

In a first aspect the invention relates to a planar, monolithically integrated coil, wherein the coil is magnetically confined.

In a preferred embodiment the present invention relates to a coil according to the invention further provided with a substrate, and back and front sided shielding, wherein the back and front side are magnetically coupled by substantially through substrate hole vias, which holes are preferably, in a 2-D projection in the plane of the coil, and inside and outside the coil.

Typically, a coil is made up of materials, which can be fashioned into a spiral or helical shape. An electromagnetic coil (or simply a "coil") is formed when a conductor (usually a solid copper wire) is wound around a core or form to create an inductor or electromagnet. One loop of wire is usually referred to as a turn, and a coil consists of one or more turns. For use in an electronic circuit, electrical connection terminals called taps are often connected to a coil. Coils are often coated with varnish and/or wrapped with insulating tape to provide additional insulation and secure them in place. A completed coil assembly with taps, etc. is often called a winding. A transformer is an electromagnetic device that has a primary winding and a secondary winding that transfers energy from one electrical circuit to another by magnetic coupling without moving parts.

In a semiconductor device a coil is typically provided with a substrate, such as silicon, or silicon oxide on silicon, etc. The coil typically has a spiral shape, but in principle the invention is also applicable to helical shapes. The spiral coil and substrate of the present invention are typically in parallel two-dimensional planes. The shielding of the present invention is also typical in parallel 2-D planes, also typically being parallel to the substrate. On the other hand the holes, connecting the shielding, are typically perpendicular to the above-mentioned 2-D planes, as can e.g. be visualized in FIG. 1.

Electromagnetic shielding is the process of limiting the flow of electromagnetic fields between two locations, by separating them with a barrier made of conductive material. Typically it is applied to enclosures, separating electrical devices from the 'outside world', and to cables, separating wires from the environment the cable runs through.

In the present invention the substrate comprises one or more holes substantially through the substrate, which holes are also referred to as vias. In typical semiconductor manufacturing processes vias are filled with an electrically conducting material, such as a metal, such as aluminum, copper, tungsten, titanium, or doped silicon, or combinations thereof. Contrary to the prior art the present invention in a preferred embodiment relates to a coil, wherein the through wafer holes are filled with high-ohmic material, such as larger than 100 mΩ.cm. Preferably the material also has a high initial permeability at 10 MHz, such as $|\mu_r|>500$, preferably $|\mu_r|>1000$, more preferably $|\mu_r|>2000$, and still has a high initial permeability at 100 MHz, such as $|\mu_r|>300$, preferably $|\mu_r|22\ 500$, more preferably $|\mu_r|>1000$.

Thus, the present invention seeks to overcome the above-mentioned problems by providing a construction method for an inductor, where confining the inductor coils by materials with a high magnetic permeability at high frequencies and with high resistivity can increase the inductance. Thus, in a preferred embodiment the present invention relates to a coil according to the invention, wherein the back and front sided shielding and or the vias comprise a material with a high magnetic permeability at high frequencies and with high resistivity. Preferably said material is formed from a so-called soft-magnetic alloy material. Soft magnetic material includes e.g. a wide variety of nickel-iron and nickel-cobalt soft magnetic alloys and nanocrystalline iron for high performance components requiring high initial and maximum permeability coupled with ease of fabrication.

Throughout the description and claims the terms "through via", "through wafer via", "thru via", "via hole" and similar expressions relate to holes or vias through the substrate, e.g. a silicon wafer. A via hole is a non-filled via.

A soft-magnetic alloy materials class referred to as nanocrystalline iron and described in J, Huijbregtse, F. Roozeboom, J. Sietsma, J. Donkers, T. Kuiper and E. van de Riet, J. Appl. Phys. Phys., 83 (1998) 1569, is preferred for cladding. In particular the $Fe_x$-$TM_y$-$O_z$ materials wherein TM represents one or more transition metals elements chosen from the Group IVa or Va elements, e.g. Ti, Zr, Hf, V, Nb, Ta, such as Fe—Hf—O, combine a high initial magnetic permeability at high frequencies with a high resistivity. A preferred material is e.g. $Fe_{55}Hf_{17}O_{28}$ that has a $|\mu r|>1000$ at 10 MHz and still a $|\mu r|\sim500$ at 100 MHz, with further a high electrical resistivity (typically 1 mΩ·cm and up).

In a further preferred embodiment the present coil comprises a back and/or front sided shielding that are/is patterned. As such eddy currents are further reduced.

In a further preferred embodiment the present coil has a pattern and further comprises a substantially ring shaped shield, preferably a rectangular shaped shield. Theoretically such a coil and shielding is somewhat worse than a shield without a ring shaped shield. However, from a manufacturing process point of view this embodiment is easier to make with existing technology. When using electrochemical deposition, in a conducting bath, the ring shaped shield may be used to attach a contact to. Thus in principle only one contact is needed, whereas in the version without the ring various contacts are needed in a bath.

In a further preferred embodiment the present coil has via holes that are not completely through, thereby forming so-called magnetic air-gaps, which gaps are present at the back and/or front side of the coil. The shields may, while in use, be saturated. The present air-gaps reduced the risk of such saturation, and thus ensure a superior performance in use.

In a further preferred embodiment the present coil has a density of via holes that is larger in the center of the coil than outside the coil. The effect thereof is similar to that of air-gaps.

In a further preferred embodiment the present coil has a thin non-conducting and non-magnetic high permeable layer between substrate and coil on the one hand and shielding on the other hand, wherein the shielding is on the same side of the substrate as the coil. Such a layer may be formed of a material chosen from e.g. a lacquer, resist, dielectric, and combinations thereof, such as silicon oxide, and silicon nitride.

In a second aspect the present invention relates to an application wherein high-value, low resistance inductors are needed, such as a DC:DC converter, an AM reception antenna, tuned HF or IF-stages up to 100 MHz, such as in an FM radio or TV reception, comprising a coil according to the invention.

The present invention is further elucidated by the following Figures and examples, which are not intended to limit the scope of the invention. The person skilled in the art will understand that various embodiments may be combined.

DETAILED DESCRIPTION OF THE DRAWINGS

Figure 1:
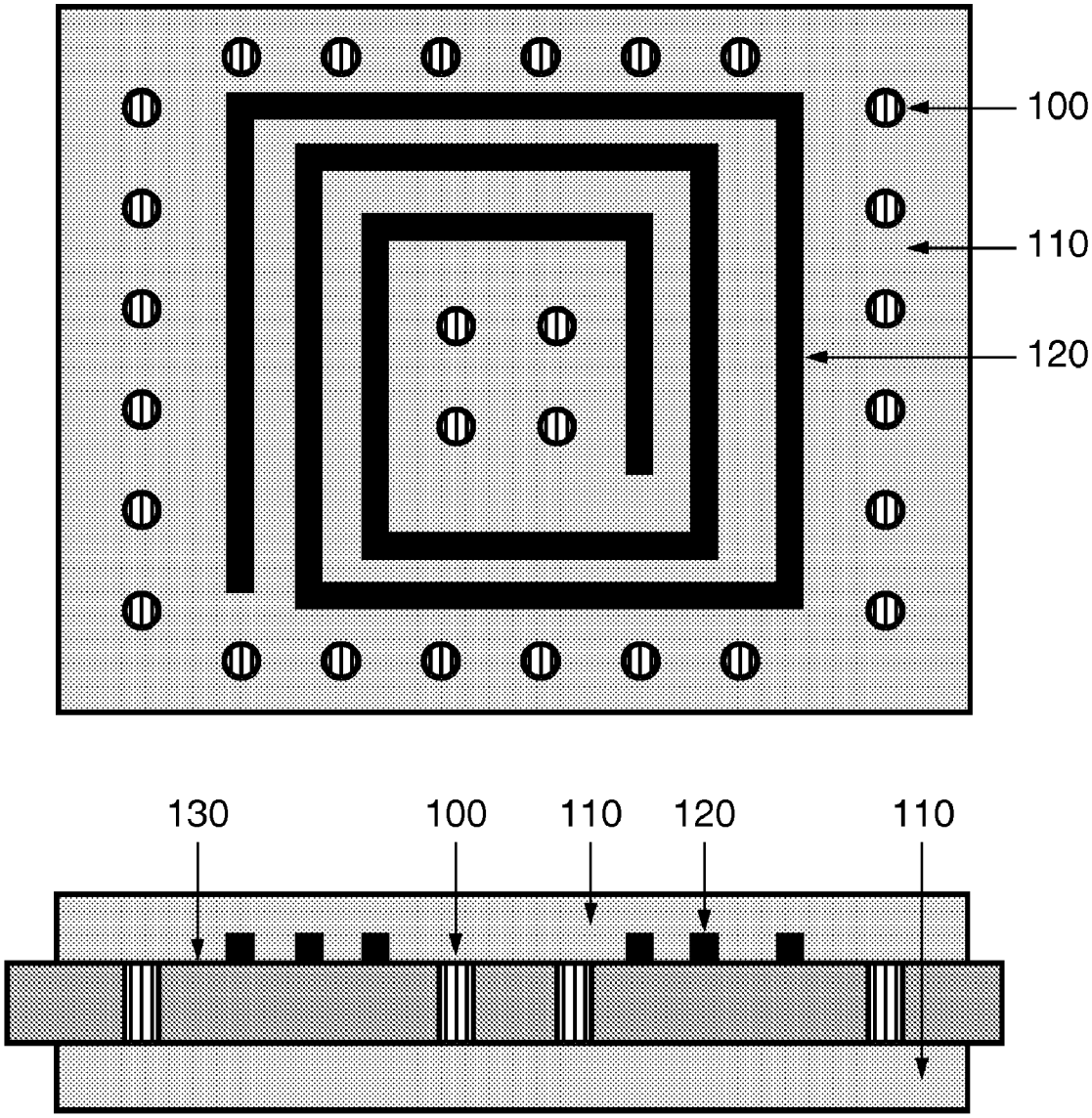
FIG. 1 shows a top and side view of a planar monolithical coil.

FIG. 1 shows a top and side view of a planar monolithical coil. Therein a coil (120), typically formed of a conductor, such as copper or aluminum, vias (100) and shield (110), made from a soft-magnetic metal alloy, and a substrate (130), typically silicon, are shown.

Basically, the inductor can be described as comprising the following elements:

1. A metal, preferably copper, inductor pattern (the turns of the coil) on a Si substrate;
2. Through-wafer via holes (typically made by RIE-etching with 10-50 μm, such as 30 μm, in diameter with depths ranging from 100 to 200 μm, depending on the wafer thickness) around the coil, and inside the coil; the vias are filled with a soft-magnetic material such as a permalloy ($Ni_{0.8}Fe_{0.2}$); alternatively, Fe—Hf—O and other high-permeability/high resistivity materials are also possible. Preferably the growth is carried out electrochemically, yet some other deposition techniques are possible as well (e.g. CVD or PVD, which have the advantage of laminating the magnetic layers;

3. Back and front side covering with a soft-magnetic material, with high permeability at high frequencies, such as ferrite or, even more preferred nanocrystalline iron alloys, such as Fe—Hf—O;

4. The soft-magnetic via filling material such as permalloy can be deposited by electrochemical plating after depostion of a conductive plating base of the same material.

The material with high magnetic permeability creates a flux path, due to which the effective inductance of the coil is much higher than without such material. As it is advantageous to fill the vias with a conductive material (to allow electrochemical growth of the material in the vias) the through vias should be preferably as small as possible in diameter (but still of a size to make manufacturability easy), to avoid eddy-currents, which would increase the AC-losses of the inductor. To allow control of electrochemical growth rate the total exposed area (open via holes) should be not too small. This can be sustained by a multiple arrays of via holes with a dense pitch of the order of their diameter. 5 Note that FIG. 2 contains only two single arrays.

Figure 2:
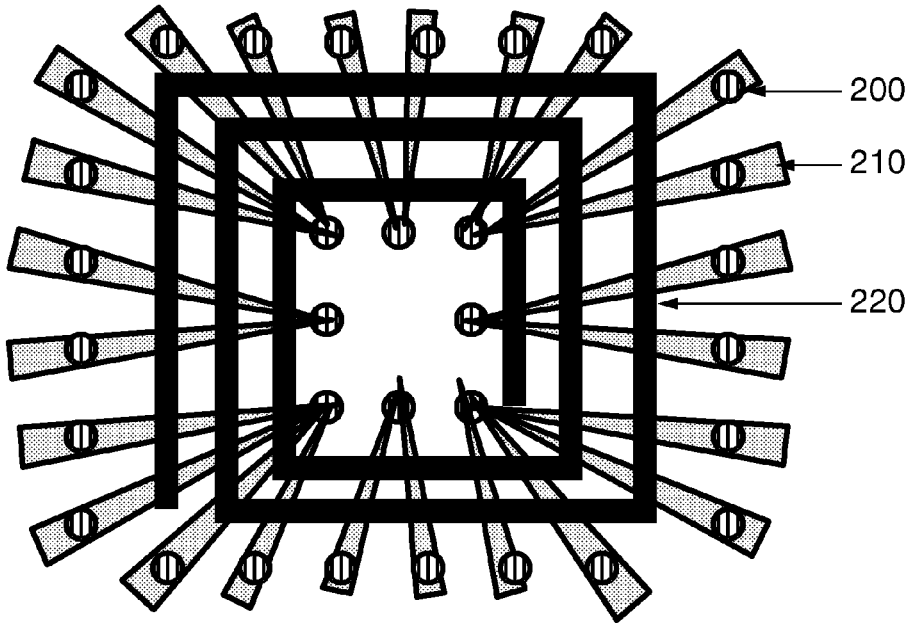
FIG. 2 shows a top view of a planar monolithical coil.

FIG. 2 shows a top view of a planar monolithical coil. Therein a coil (220), and vias (200) and shield (210), are shown. Here, the Fe—Hf—O or ferrite is replaced by a patterned permalloy. Obviously, care should be taken that the patterning of the permalloy is such as to minimize eddy current losses in the permalloy material. The typical dimension of the patterning should be of the order of the skin depth of the material. For most NiFe alloys, this gives a typical dimension of about 5 mm at about 25 MHz. The patterning shown is an example, more complex patternings could be envisaged as well. To optimally contribute to increasing the effective permeability, the stripes must form a closed magnetic path through the permalloy-filled vias (such a closed path would exist of a single stripe on the front side, a via to a single stripe on the back, and a connection to the first via again through a second via).

Figure 3:
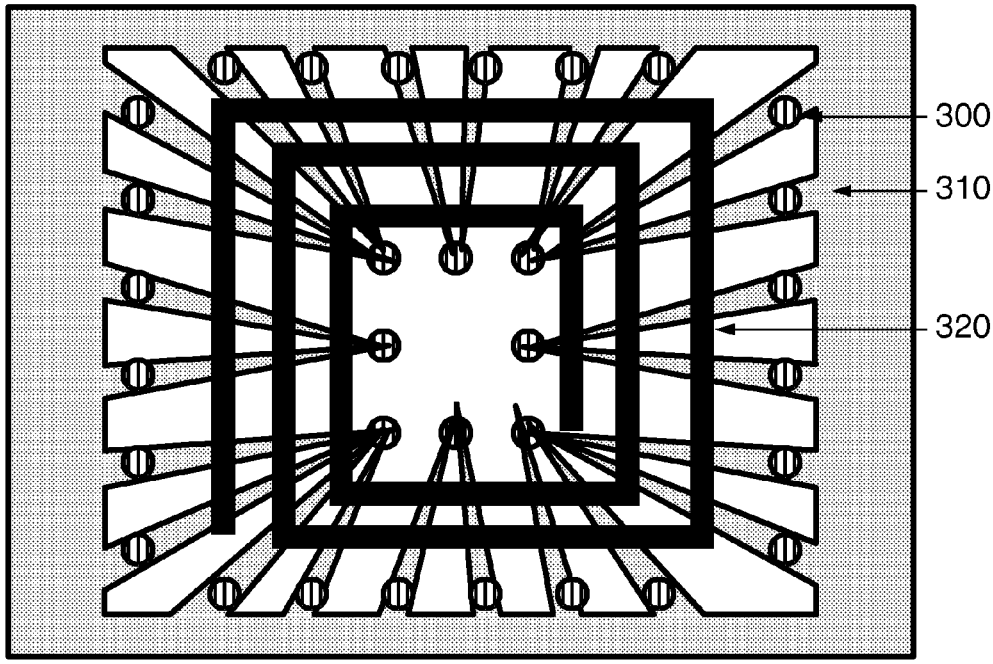
FIG. 3 shows a top view of a planar monolithical coil.

FIG. 3 shows a top view of a planar monolithical coil. Therein a coil (320), and vias (300) and shield (310), are shown. Electrodeposition of the patterned layer may be difficult if no low-ohmic contacts exist. This could be solved by adding a second ring of permalloy close to the outer ring of vias, as illustrated in FIG. 3.

Because the ring does no longer enclose any magnetic flux, no eddy currents will be generated in the material.

Figure 4:
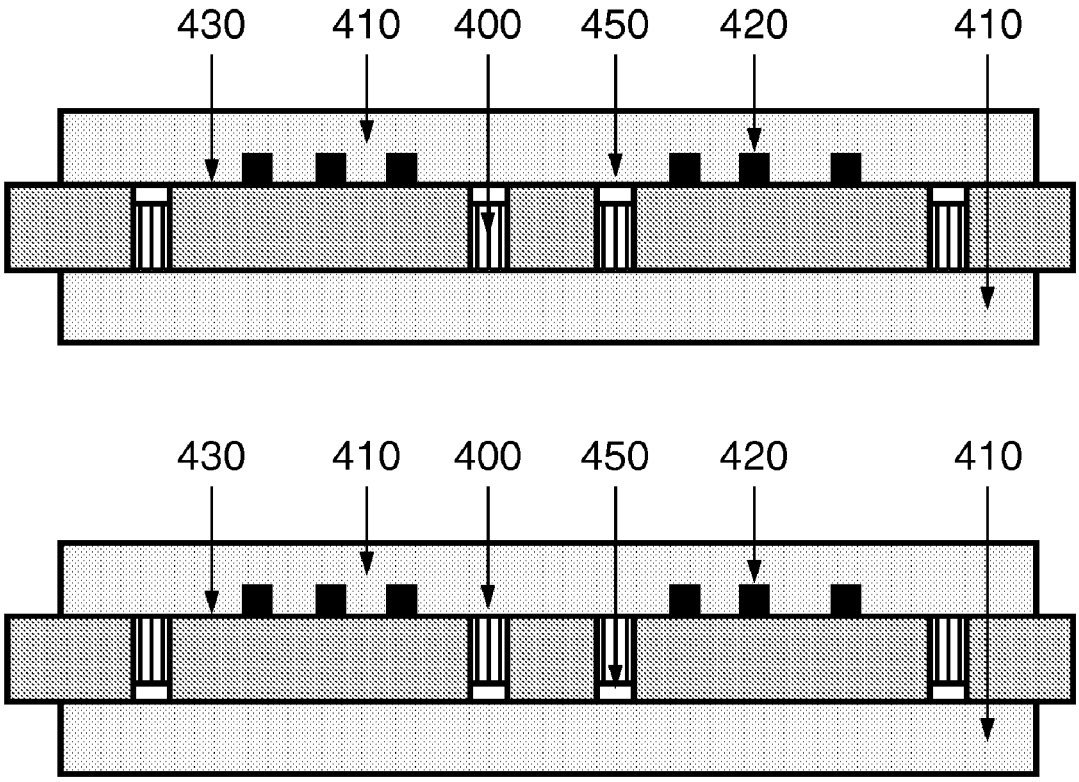
FIG. 4 shows a side view of a planar monolithical coil.

FIG. 4 shows a side view of a planar monolithical coil. Therein a coil (420), and vias (400) and shield (410), as well as a substrate (430), and air gaps (450) are shown. A further realization can be made exploiting the fact that the vias filled with soft magnetic material need not be completely thru-hole; when they are not completely thru-hole, a magnetic 'air-gap' is created. This is schematically depicted in FIG. 4. The vias as drawn in FIG. 4*a* create an air-gap at the top-side; obviously, it is equally well possible to create a gap at the bottom side (FIG. 4*b*), as well as a combination of both.

Figure 5:
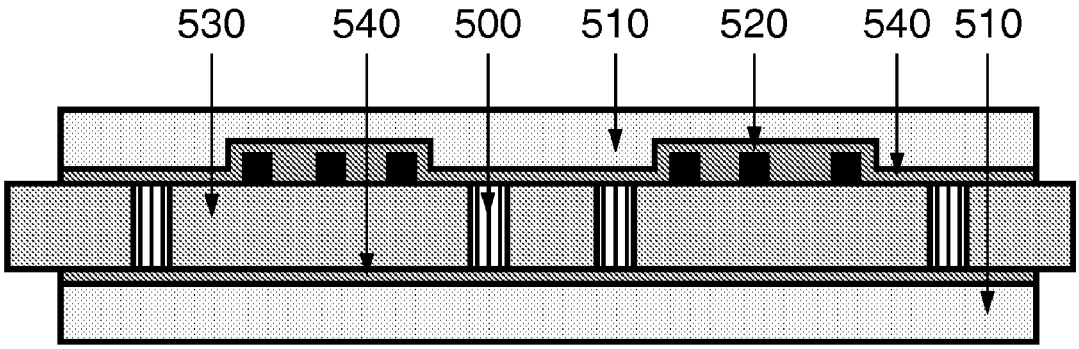
FIG. 5 shows a side view of a planar monolithical coil.

FIG. 5 shows a side view of a planar monolithical coil. Therein a coil (520), and vias (500) and shield (510), as well as a substrate (530), and an extra layer (540) are shown. Further, it is possible the create vias that fully penetrate the silicon substrate, and are subsequently covered by a protective layer (or a photo resistive lacquer such as SU8) which may be necessary to create the copper tracks. This is illustrated in the FIG. 5. In this picture, a realization is shown where it is also illustrated that it can be advantageous to have a relatively large density of magnetic vias in the centre of the inductor.

As an example, the following set of parameters can be used:

f=30 MHz

10 μm permalloy layer thickness

200 μm Si substrate $M\mu=1000+1000j$—which is a pessimistic estimate where the permalloy is rather lossy This results in the following characteristics of the inductor:

Saturation current ~100 mA

An AC resistance roughly half of the DC resistance Rdc~0.5 Rac A DC resistance over inductance ratio R/L~5 mΩ/nH, which is about a factor of 10 better than an air coil inductor without the magnetically active material.

The inductor is made using standard copper electroplating on silicon, and subsequent patterning as to create a planar coil (which can be square as in FIG. 1, or any other planar geometry). The thickness of the copper layer is not specific, but for low DC resistance, thick copper (several μm's) is preferable. Then, a highly permeable material, such as is deposited by electrochemical deposition. Alternatively, RF sputter deposition can be used from, e.g. an $Fe_{83}Hf_{17}$ target in reactive atmosphere ($Ar+O_2$), etc. as described in the above mentioned article.

Embodiment 1

Basically, the present inductor can be manufactured by:

1. RIE or wet etching of a pattern of through-wafer via holes in a silicon substrate, plus subsequent (electrochemical) filling by permalloy (NiFe) electrodeposition; subsequent cap layer deposition over through holes.

2. Electrodeposition and subsequent patterning of a (~5-8 μm thick) Cu-coil pattern (the turns of the coil) on the Si substrate; can be done in pre-deposited and patterned SU-8 (or equivalent resist) or as a blanket layer that is patterned after the deposition 3. Electro deposition of a NiZn permalloy, and subsequent patterning to reduce eddy currents, or 4. Alternatively to step 3, back and front side RF sputter deposition of a soft-magnetic material, with high permeability at high frequencies, such as ferrite or, even more preferred nanocrystalline iron alloys, such as Fe—Hf—O For example: a nanocrystalline $Fe_{55}Hf_{17}O_{28}$ layer of up to 10 μm thickness can be sputter deposited from an $Fe_{83}Hf_{17}$ target in reactive atmosphere ($Ar+O_2$), etc. as described in the above mentioned article.

Here only the major process steps have been described. Additional steps in between may be necessary to implement in order to screen off critical substrate areas in a previous flowchart step.

The invention claimed is:

1. A planar, monolithically integrated coil, wherein the coil is magnetically confined, has a back side, a front side, and has a plurality of substrate via holes disposed both inside and outside of a perimeter of the coil, wherein the substrate via holes are filled with high-ohmic material having a high initial permeability at 10 MHz of $|\mu_r|>500$ and magnetically couple the back side to the front side; the magnetically confined coil further comprises: a substrate; and back and front sided shielding, wherein the back side and front side shielding, which are patterned to extend radially, are magnetically coupled by the substrate via holes which are in a 2-D projection in a plane of the coil.

2. The coil according to claim 1, wherein at least one of the back and front sided shielding and the via holes comprises a material with a high magnetic permeability at high frequencies and with high resistivity.

3. The coil according to claim 1, wherein at least one of the back and the front sided shielding is patterned.

4. The coil according to claim 3, wherein the pattern comprises a substantially ring shaped shield.

5. The coil according to claim 1, wherein the via holes are not completely through, thereby forming magnetic air-gaps, which gaps are present at the back and/or front side of the coil.

6. The coil according to claim 1, wherein a density of via holes is larger in a center of the coil than outside the coil.

7. The coil according to claim 1, further comprising:

at least one non-conductive and non-magnetic high permeable layer that is situated between the substrate and the back and the front sided shielding.

8. An application selected from a group of a DC:DC converter, an AM reception antenna, and tuned HF or IF-stages up to 100 MHz, comprising the coil according to claim 1.

9. The coil of claim 1, wherein the substrate via holes are filled with high-ohmic material having a high initial permeability at 10 MHz of $|\mu_r|>1000$.

10. The coil of claim 9, wherein the substrate via holes are filled with high-ohmic material having a high initial permeability at 10 MHz of $|\mu_r|>2000$.

11. The coil of claim 1, wherein the high-ohmic material comprises a transition metal element.

12. The coil of claim 11, wherein the transition metal element is Hafnium (Hf).

13. The coil of claim 11, wherein the high-ohmic material is $Fe_{55}Hf_{17}O_{28}$.

14. The coil of claim 1, wherein the coil has a spiral shape.

15. A planar, monolithically integrated coil, wherein the coil is magnetically confined, has a back side, a front side, and has a plurality of substrate via holes disposed both inside and outside of a perimeter of the coil, wherein the substrate via holes are filled with high-ohmic material having a high initial permeability at 100 MHz of $|\mu_r|>300$ and magnetically couple the back side to the front side; the magnetically confined coil further comprises: a substrate; and back and front sided shielding, wherein the back side and front side shielding, which are patterned to extend radially, are magnetically coupled by the substrate via holes which are in a 2-D projection in a plane of the coil.

16. The coil of claim 15, wherein the substrate via holes are filled with high-ohmic material having a high initial permeability at 100 MHz of $|\mu_r|>500$.

17. The coil of claim 16, wherein the substrate via holes are filled with high-ohmic material having a high initial permeability at 100 MHz of $|\mu_r|>1000$.

18. A planar, monolithically integrated coil, wherein the coil is magnetically confined, has a back side, a front side, and has a plurality of substrate via holes disposed both inside and outside of a perimeter of the coil, wherein the substrate via holes are filled with a nanocrystalline iron alloy and magnetically couple the back side to the front side; the magnetically confined coil further comprises: a substrate; and back and front sided shielding, wherein the back side and front side shielding, which are patterned to extend radially, are magnetically coupled by the substrate via holes which are in a 2-D projection in a plane of the coil.

* * * * *